US006619910B1

(12) United States Patent
Burgess

(10) Patent No.: US 6,619,910 B1
(45) Date of Patent: Sep. 16, 2003

(54) FROTH PUMPS

(75) Inventor: Kevin Edward Burgess, Artarmon (AU)

(73) Assignee: Warman International Limited, Artarmon (AU)

( * ) Notice: Subject to any disclaimer, the term of this patent is extended or adjusted under 35 U.S.C. 154(b) by 0 days.

(21) Appl. No.: 09/856,153

(22) PCT Filed: Nov. 5, 1999

(86) PCT No.: PCT/AU99/00981

§ 371 (c)(1),
(2), (4) Date: Sep. 17, 2001

(87) PCT Pub. No.: WO00/34663

PCT Pub. Date: Jun. 15, 2000

(30) Foreign Application Priority Data

Dec. 4, 1998 (AU) ..... PP 7508

(51) Int. Cl.[7] ..... F04D 29/28
(52) U.S. Cl. ..... 415/74; 415/143; 415/199.6
(58) Field of Search ..... 415/143, 169.1, 415/71, 72, 74, 199.6; 416/175, 176, 177, 203

(56) References Cited

U.S. PATENT DOCUMENTS

| | | | | |
|---|---|---|---|---|
| 3,597,904 A | 8/1971 | Jakobsson et al. | ..... | 55/408 |
| 3,644,056 A | 2/1972 | Wiselius | ..... | 415/215 |
| 3,918,841 A | 11/1975 | Kida et al. | ..... | 416/183 |
| 5,039,320 A | 8/1991 | Hoglund et al. | ..... | 55/203 |
| 5,413,460 A | 5/1995 | Wilson et al. | ..... | 415/206 |

FOREIGN PATENT DOCUMENTS

| | | |
|---|---|---|
| DE | 573029 | 3/1933 |
| DE | 2618559 A1 | 11/1977 |

OTHER PUBLICATIONS

Derwent Abstract Accession No. 96–397702/40, JP 8193598A, (Matsushita Denki Sangyo KK), Jul. 30, 1996.

Derwent Abstract Accession No. 96–167980/17, JP 8049695A, (Matsushita Denki Sangyo KK), Feb. 20, 1996.

Pumps–Types, Selection, Installion, Operation and Maintenance, Kristal et al, pp. 218–219, 1953.

*Primary Examiner*—Edward K. Look
*Assistant Examiner*—Dwayne J. White
(74) *Attorney, Agent, or Firm*—Jacobson Holman PLLC

(57) ABSTRACT

An impeller suitable for use in a centrifugal pump, the pump including a pump chamber and a pump inlet. The impeller includes a main body portion which includes a plurality of primary pumping blades or vanes and one or more flow inducing blades or vanes which project from the main body portion of the impeller and when installed into the pump inlet.

10 Claims, 4 Drawing Sheets

FROTH PUMPS

This invention relates generally to apparatus for pumping fluids and more particularly, to an impeller for a pump which is suitable for use in the pumping of frothy fluids such as flotation concentrate. An example of such frothy fluid may typically include a mixture of water, air, and mineral particles which can be generated by the flotation of minerals in mining processing plants. It will be appreciated from the following description however that the invention could be suitable for use in other applications. For example, the pump may be suitable for use with viscous slurries.

Mineral processing plants often utilise a process known as flotation to separate the required mineral from the waste rock. This is achieved in a flotation tank or cell in which the slurry is placed and fine air bubbles and reagents are added. The tank is then agitated and the resulting froth which rises to the top of the flotation cell has the fine particles of the required mineral adhering to the froth bubbles. Collection of the froth then provides a means of collecting the required mineral extracted by the process.

The froth from the flotation process contains the required mineral and normally must be pumped to the next processing stage. The different types of froth produced depend a lot on the particles sizes being floated, the type and quantity of reagents and the quantity and size of the air bubbles. The froth process is continuous but at the current time there was no commercial equipment that can reduce the air content of the froth and it is not practical to leave it until the air separates by itself before pumping the froth.

To achieve good recovery results, requires that the mineral be ground to very fine sizes (in some cases less than 10 micron). Also to achieve good mineral recovery the reagents used need to be controlled but quite often this combined with the amount of bubbles necessary to make the process efficient results in a very stable and tenacious froth. These tenacious froths when left in a container would typically take 12 to 24 hours to reduce to the water and solid state only, ie. the bubbles would be extremely slow to disperse.

Pumps for use for pumping froth currently are in the form of vertical and/or horizontally disposed pumps. Vertical pumps are arranged so that the pump inlet is disposed generally vertically and horizontal pumps are arranged with the pump inlet disposed generally horizontally. Vertical froth pumps have been demonstrated to pump very tenacious froth but are quite often physically large and really must be considered in the initial design of a mineral plant, Horizontal pumps on the other hand have been used for froth pumping but are not always successful with tenacious froths. Horizontal pumps have traditionally been deliberately oversized in froth applications. A larger pump means that they can be inefficient with the resultant low flow and high air entrainment due to the froth in a large pump. Mechanical failures can become a problem with unsteady pumping. Froth is full of air but being very small bubble sizes has less effect than the same quantity of air in the form of large bubbles. However, there is a point at which a pumps tolerance to froth will drop due to the effects of the air. The air tolerance of a pump is also related to the net positive suction (NPSH) characteristic; that is, the lower the net pressure available at the intake to the pump the more likely it is that the performance will become effected.

It is an object of the present invention to provide an improved impeller which is suitable for use in froth pumps and improves the performance thereof.

According to one aspect of the present invention there is provided an impeller suitable for use in a centrifugal pump, the pump including a pump chamber and a pump inlet, the impeller including a main body portion which includes a plurality of primary pumping blades or vanes and one or more flow inducing blades or vanes which project from the main body portion of the impeller.

According to another aspect of the present invention there is provided a centrifugal pump including a pump chamber and a pump inlet, and an impeller including a main body portion which includes a plurality of primary pumping blades or vanes and one or more flow inducing generating blades or vanes which project from the main body portion of the impeller, the main body portion of the impeller being within the pump chamber and the or each flow inducing blade extending into the pump inlet, the impeller being mounted for rotation about a central rotation axis and the pump inlet being in the region of the rotation.

The arrangement is such that when in an installed position in the pump, the main body portion of the impeller is disposed within the pump chamber and the or each flow inducing blade extends into the pump inlet. The impeller is mounted for rotation about a central rotation axis and the pump inlet is disposed in the region of the rotation axis. The fluid is then pumped by the pumping vanes and exits therefrom at the periphery of the impeller. The, arrangement is such that the flow of fluid into pump chamber has combined axial and radial flow components.

In one form the main body portion of the impeller includes a shroud on one side of the primary pumping blades, the shroud being remote from the pump inlet when in the installed position. In this particular embodiment, the pumping blades project from the shroud and have a free edge which is adjacent to the pump inlet side of the pumping chamber when in the installed position. Preferably, the or each flow inducing blade is secured to the free edge of one or more of the pumping blades and when installed projects into the inlet. Preferably, each pumping blade has a flow inducing blade associated therewith.

In another form of the invention, the main body includes two spaced apart shrouds with the pumping blades therebetween. In this embodiment, the or each flow inducing blade projects from the shroud adjacent the pump inlet side of the pumping chamber and extends into the inlet.

Preferably, the or each flow inducing blade has an edge which is secured to or integral with a section of the free edge of a pumping blade and extends outwardly therefrom with a face which extends in a generally partially spiral section.

The shape of the flow inducing blades and their position when in the installed position provides additional rotation to the froth before it enters the pump and at the same time provide a better and smoother inlet to the main impeller passageway for the froth. The effect of the flow inducing blades also lowers the net positive head limit requirement that is needed for the pump to perform correctly with tenacious froths for example.

Tenacious froths generally have a high air content so it is difficult to exert any type of force or pressure force to the froth as the forces are not transmitted through the balk of the froth. Hence, the froth will not easily enter the intake of the pump impeller. As the pump impeller adds energy to the fluid or froth it is pumping, it can be seen that it is a necessary requirement to allow the froth to enter the impeller by the easiest means possible. The present invention as well as reducing the inlet NPSH requirements allows the blades or vanes to extend into the pump intake and provides a very much larger improved entry to the impeller; that is less constriction and loss at the impeller entry. When the impeller is rotating the vanes would in practice "peel off" or "scoop up" the tenacious froth. By this action the froth will be more easily drawn in to the impeller for pumping.

The invention could normally be applied to any existing pump design but in particular is suitable for horizontal slurry pumps and slurry pumps with an inlet that is larger than is normally required. It could also be applied more easily to open impellers. That is impellers which do not have a front shroud however, as has been described there is nothing preventing the invention being applied to standard pumps or to closed impellers.

Furthermore, the impeller of the invention could be suitable for use to pump any difficult slurry or fluid such as high density visco muds and is therefore not specifically limited to the pumping of froths.

Preferred embodiments of the invention will hereinafter be described with reference to the accompanying drawings in which.

Figure 3:
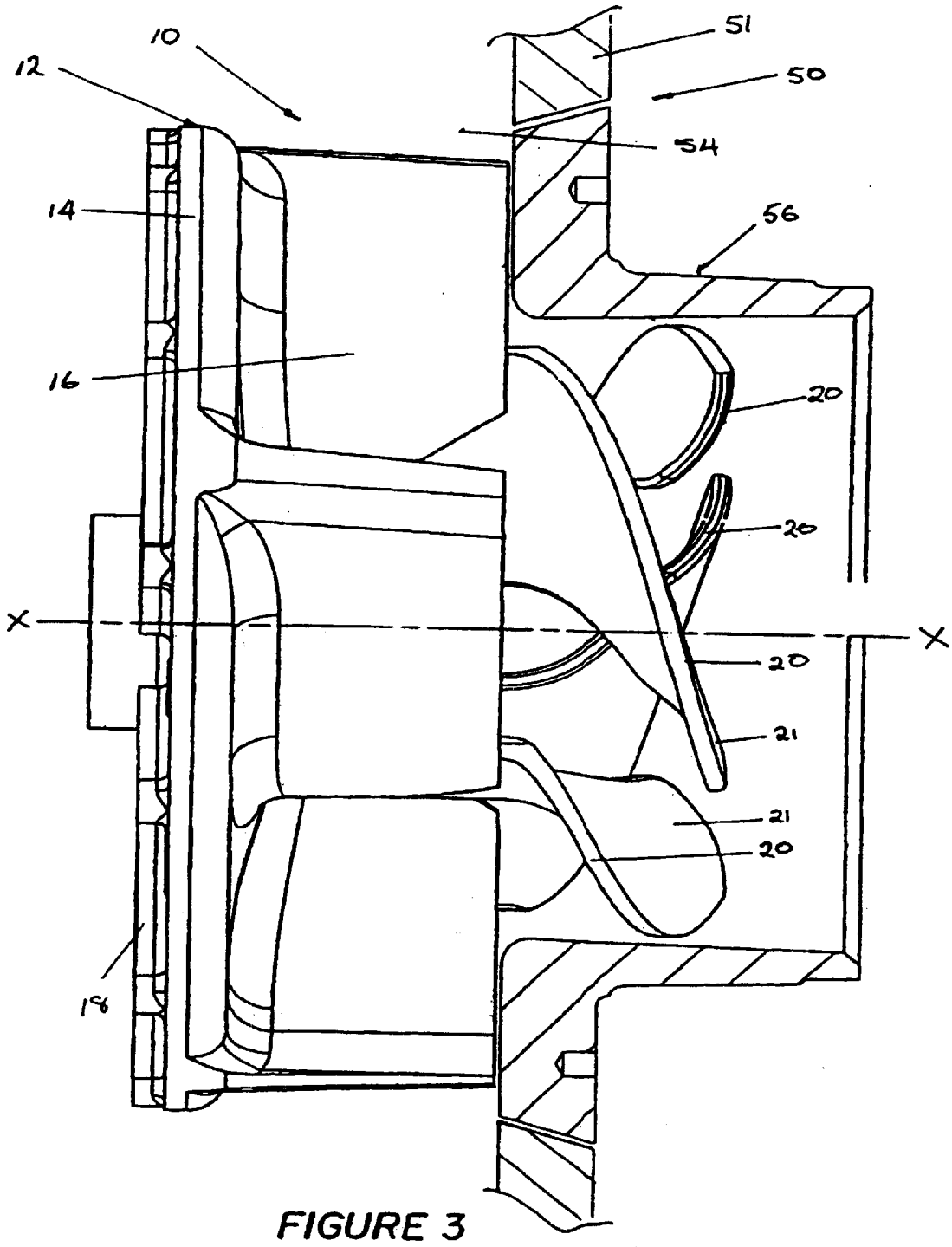
FIG. 3 is a schematic side elevation showing the impeller of FIGS. 1 and 2 installed within a pump chamber.
Figure 4:
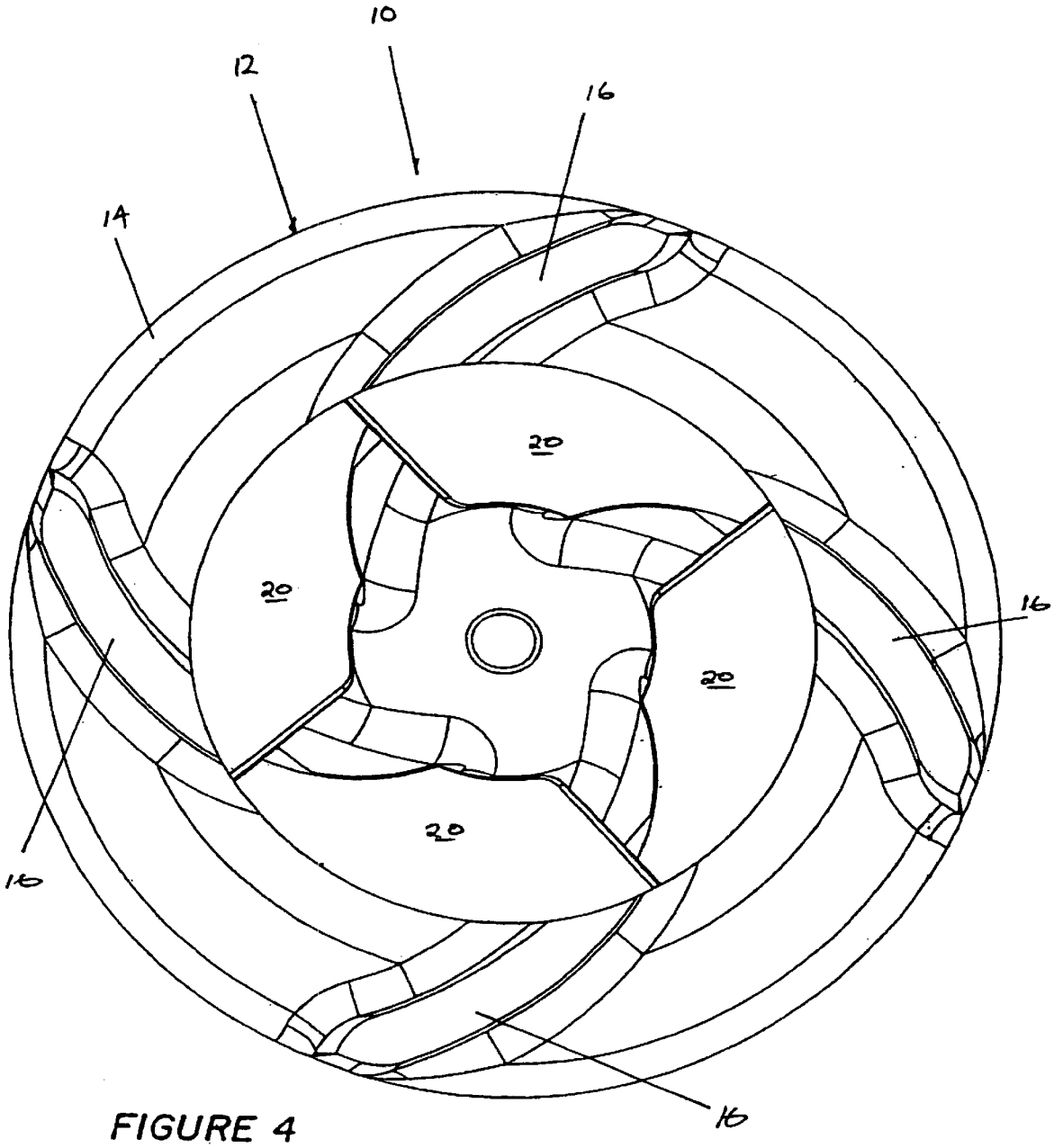
FIG. 4 is a front elevation of the pump impeller shown in FIGS. 1 to 3.

Referring firstly to FIG. 3 there is shown, in partial sectional side elevation part of a centrifugal pump generally indicated at 50 which includes a pump casing 51 which may or may not have a pump line therein a pump chamber 54 and a pump inlet 56. There is further shown an impeller 10 which is mounted within the pumping chamber 54 for rotation about rotation axis X—X.

Figure 1:
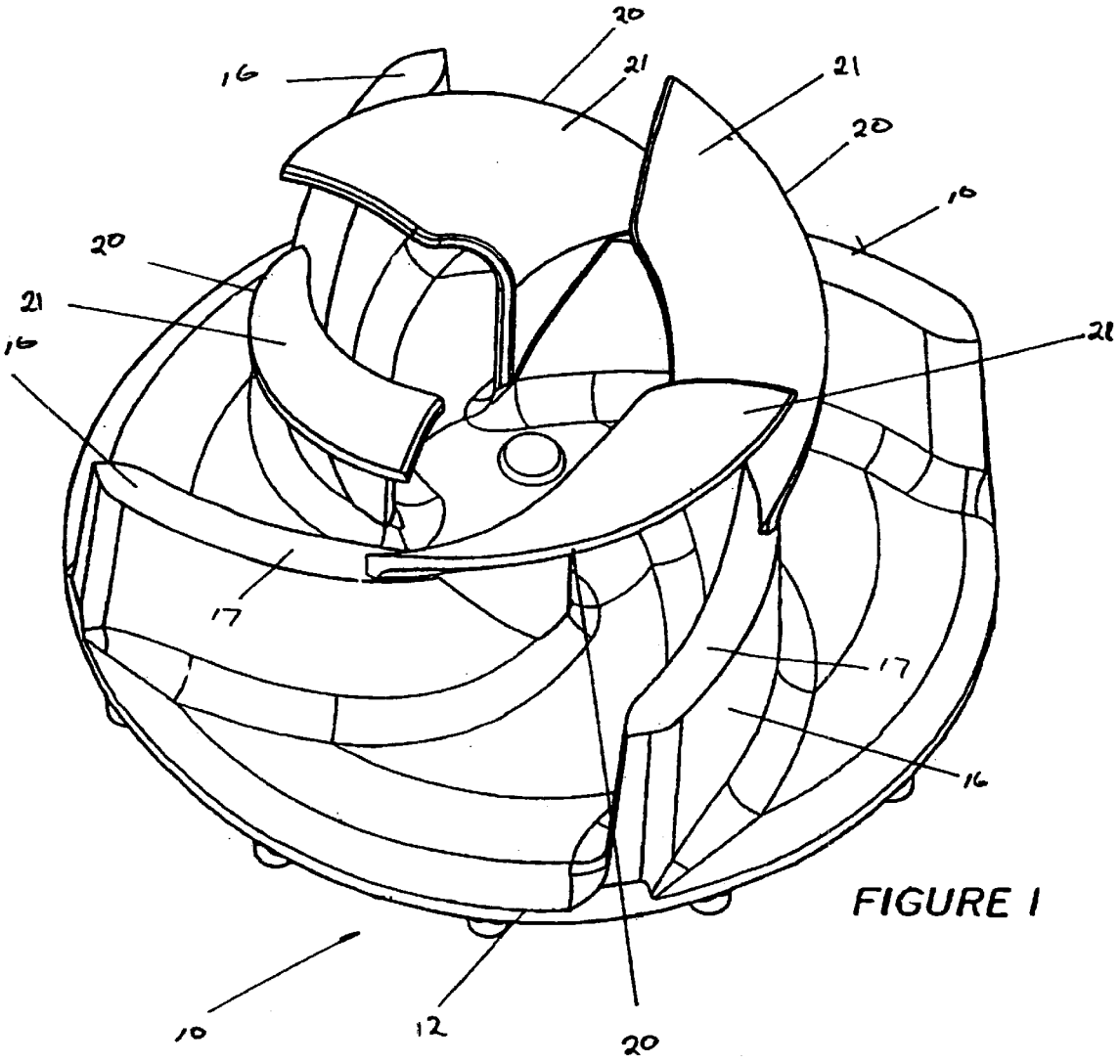
FIG. 1 is a schematic perspective view of one embodiment of impeller according to the present invention.
Figure 2:
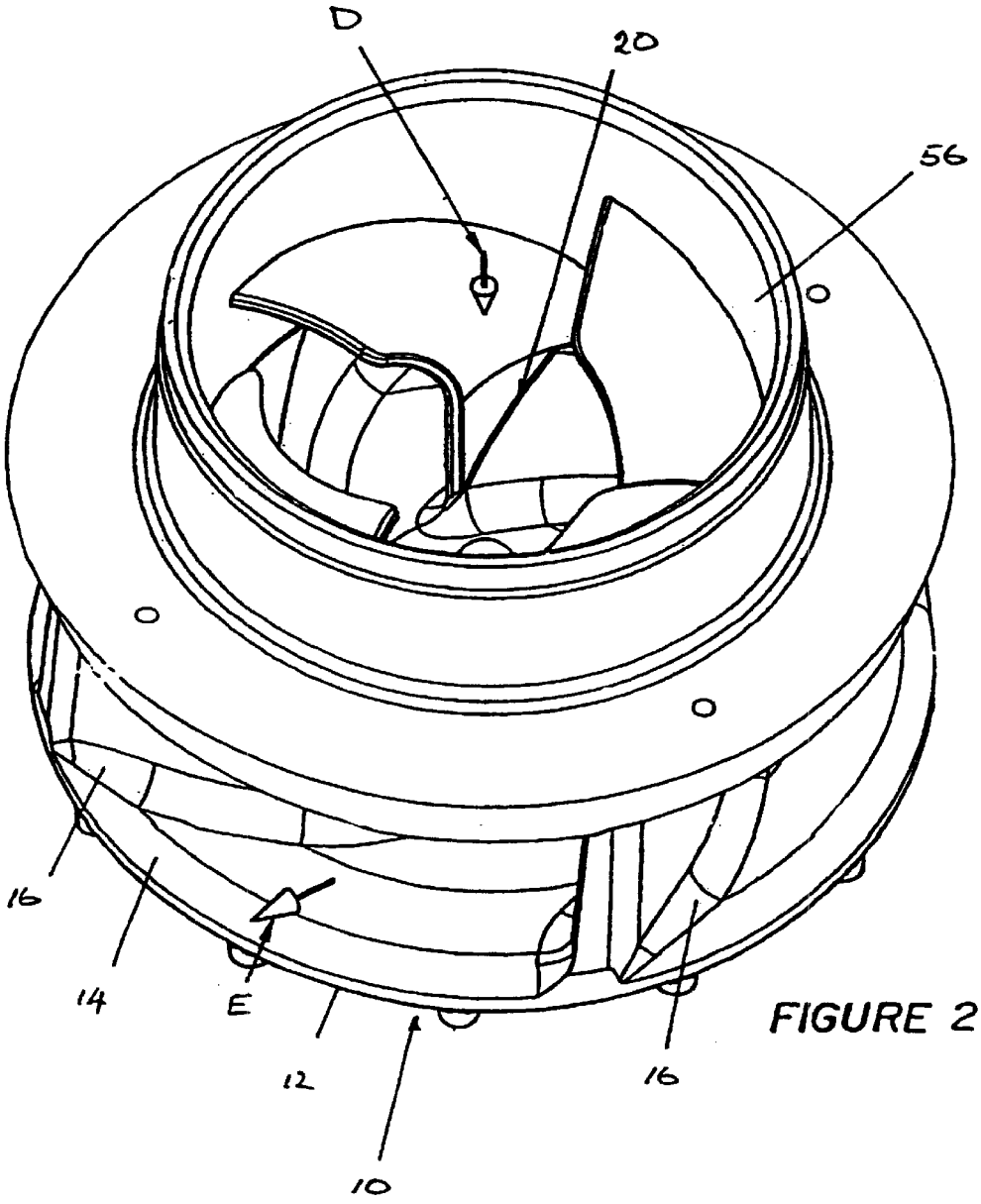
FIG. 2 is a schematic perspective view of the pump impeller and pump inlet section of a pump.

In the embodiment shown the impeller 10 includes a main body portion 12 having a rear shroud 14 having expeller blades 18 on the back face and a series of pumping blades 16 projecting therefrom towards the pump inlet 56. The impeller 10 includes a plurality of flow inducing blades 20 each projecting from a respective pumping blade 16 into the pump inlet 56. As shown in FIG. 2, material enters the impeller in the direction of arrow D and passes out in the direction of arrow E.

As shown in FIG. 3 when the impeller 10 is installed in the pump 50, the main body portion 12 of the impeller is disposed within the pump chamber 54 and the flow inducing blades 20 extend into the pump inlet 56. The pump inlet 56 is disposed in the region of the rotation axis X—X and arrange so that incoming fluid enters the pump chamber with both axial and radial flow components. The fluid is then pumped by the pumping vanes and exits therefrom at the periphery of the impeller.

The pumping blades 16 are conventional form and have a free edge 17 with the flow inducing blades 20 projecting from a portion thereof. Each flow inducing blade 20 includes a face 21 which extends from the pumping blades in a generally part spiral fashion. Each flow inducting blade 20 is secured to or formed integral with the free side edge 17 of a respective pumping blade 16. As shown there are four pumping blades and four associated flow inducing blades.

Finally, it is to be understood that various alterations, modifications and/or additions may be incorporated into the various constructions and arrangements of parts without departing from the spirit or ambit of the invention.

We claim:

1. A pump impeller suitable for use in a centrifugal pump for pumping froth or viscous fluids, the pump including a pump chamber and a pump inlet, the impeller, when installed in the froth pump chamber being mounted for rotation about an axis of rotation and including a main body portion which includes a plurality of primary pumping blades or vanes each having a free front edge and one or more flow inducing blades or vanes secured to or integral with the main body portion and extending beyond the free front edge of the primary pumping blades or vanes generally in the direction of the axis of rotation, the or each flow inducing blade or vane having a face which is generally of a partially spiral configuration and axially spaced from the free front edge of the primary pumping blades, and when in the installed position projects into the pump inlet.

2. The pump impeller according to claim 1 wherein each pumping blade or vane has one said flow inducing blade or vane associated therewith.

3. The pump impeller according to claim 1 wherein the or each flow inducing blade or vane has an edge which is secured to or integral with a section of the free front edge of one of the pumping blade or vane.

4. The pump impeller according to claim 1 wherein the main body portion of the impeller includes a shroud on one side of the primary pumping blades or vanes, the shroud being remote from the pump inlet when in the installed position.

5. The pump impeller according to claim 4 wherein the pumping blades or vanes project from the shroud the free edge of each is adjacent to the pump inlet side of the pumping chamber when in the installed position.

6. The pump impeller according to claim 1 wherein the main body includes two spaced apart shrouds with the pumping blades or vanes therebetween.

7. The pump impeller according to claim 6 wherein the or each flow inducing blade or vane projects from the shroud adjacent the pump inlet side of the pumping chamber and extends into the inlet.

8. A centrifugal pump for pumping froth or viscous fluids including a pump chamber and a pump inlet, and an impeller mounted for rotation within the pump chamber about an axis of rotation including a main body portion which includes a plurality of primary pumping blades or vanes each having a free front edge and one or more flow inducing blades or vanes secured to or integral with the main body portion and extending beyond the free front edge of the primary pumping blades or vanes generally in the direction of the axis of rotation, the or each flow inducing blade or vane having a face which is generally of a partially spiral configuration and axially spaced form the free front edge of the primary pumping blades, and projects into the pump inlet.

9. The centrifugal pump according to claim 8 wherein the impeller includes a shroud on one side of the primary pumping blades or vanes, the shroud being remote from the pump inlet when in the installed position, the pumping blades or vanes projecting from the shroud, the free front edge is adjacent to the pump inlet side of the pumping chamber, the or flow inducing blade or vane being secured to or integral with the free edge of one or more of the pumping blades and projecting into the inlet.

10. The centrifugal pump according to claim 8 wherein the main body includes two spaced apart shrouds with the pumping blades or vanes therebetween, the or each flow inducing blade or vane projecting from the shroud adjacent the pump inlet side of the pumping chamber and extending into the inlet.

* * * * *